US006039061A

United States Patent [19]

Utley

[11] Patent Number: 6,039,061

[45] Date of Patent: Mar. 21, 2000

[54] SKI POST-MOUNTED BOAT UMBRELLA

[76] Inventor: Jeff Utley, 5001 Megan Ct., Rocklin, Calif. 95765

[21] Appl. No.: 09/036,410

[22] Filed: Mar. 5, 1998

[51] Int. Cl.[7] ..... A45B 3/00; A45B 5/00

[52] U.S. Cl. ..... 135/16; 114/361

[58] Field of Search ..... 135/16, 19, 20.1, 135/98; 114/361, 270

[56] References Cited

U.S. PATENT DOCUMENTS

| | | | |
|---|---|---|---|
| 2,634,740 | 4/1953 | Duke | 135/98 |
| 2,769,451 | 11/1956 | Edgin | 114/361 |
| 5,441,066 | 8/1995 | Harris | 135/98 |

FOREIGN PATENT DOCUMENTS

| | | | |
|---|---|---|---|
| 2337177 | 4/1975 | Germany | 135/16 |

*Primary Examiner*—Michael Safavi

[57] ABSTRACT

A boat umbrella including a boat with a post upwardly extending therefrom. A base is provided having a rod including a pair of resilient sleeves mounted to the rod of the base via clamps in concentric relationship with respect to each other such that an axis about which the sleeves are situated resides in parallel with that of the rod. The sleeves include a first sleeve mounted at a lower end of the rod of the base and a second sleeve mounted at a central extent of the rod of the base. The rod of the base also has a threaded bore formed therein adjacent to an upper end thereof for receiving a set screw. The sleeves are designed to releasably receive the post of the boat such that the rod of the base is vertically oriented. An umbrella assembly including a member with a top end having a collapsible umbrella mounted thereon and a bottom end is removably situated within the upper end of the rod of the base and secured therein via the set screw.

4 Claims, 1 Drawing Sheet

SKI POST-MOUNTED BOAT UMBRELLA

BACKGROUND OF THE INVENTION

1. Field of the Invention

The present invention relates to boat canopies and more particularly pertains to a new ski post-mounted boat umbrella for allowing the selective shading of a ski boat.

2. Description of the Prior Art

The use of boat canopies is known in the prior art. More specifically, boat canopies heretofore devised and utilized are known to consist basically of familiar, expected and obvious structural configurations, notwithstanding the myriad of designs encompassed by the crowded prior art which have been developed for the fulfillment of countless objectives and requirements.

Known prior art boat canopies include U.S. Pat. No. 4,789,200; U.S. Pat. No. 5,277,211; U.S. Pat. No. 4,974,807; U.S. Pat. No. 503,338; U.S. Pat. No. 3,148,851; and Foreign Patents WO 94/27863 and WO 90/11702.

In these respects, the ski post-mounted boat umbrella according to the present invention substantially departs from the conventional concepts and designs of the prior art, and in so doing provides an apparatus primarily developed for the purpose of allowing the selective shading of a boat.

SUMMARY OF THE INVENTION

In view of the foregoing disadvantages inherent in the known types of boat canopies now present in the prior art, the present invention provides a new ski post-mounted boat umbrella construction wherein the same can be utilized for allowing the selective shading of a boat.

The general purpose of the present invention, which will be described subsequently in greater detail, is to provide a new ski post-mounted boat umbrella apparatus and method which has many of the advantages of the boat canopies mentioned heretofore and many novel features that result in a new ski post-mounted boat umbrella which is not anticipated, rendered obvious, suggested, or even implied by any of the prior art boat canopies, either alone or in any combination thereof.

To attain this, the present invention generally comprises a ski boat with a smooth cylindrical post having a bottom end fixedly coupled to a central extent of the boat. The post extends upwardly from the boat for releasably coupling with a line for pulling a skier. Also included is a base with a thin hollow rod having a diameter less than that of the cylindrical post of the ski boat. The rod includes a pair of resilient hollow cylindrical sleeves each having an open top and an open bottom. Each sleeve is equipped with a diameter equal to that of the cylindrical post of the ski boat. The sleeves are mounted to the rod of the base via clamps in concentric relationship with respect to each other. Further, an axis about which the sleeves are situated resides in parallel with that of the rod. The sleeves include a first sleeve mounted at a lower end of the rod of the base and a second sleeve mounted at a central extent of the rod of the base. The rod of the base further has a threaded bore formed therein adjacent to an upper end thereof for receiving a set screw. In use, the sleeves are adapted to releasably receive the cylindrical post of the ski boat such that the rod of the base is vertically oriented. Finally, an umbrella assembly is provided including a solid cylindrical member with a top end having a collapsible umbrella mounted thereon. A bottom end of the umbrella is removably situated within the upper end of the rod of the base and further secured therein via the set screw.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new ski post-mounted boat umbrella apparatus and method which has many of the advantages of the boat canopies mentioned heretofore and many novel features that result in a new ski post-mounted boat umbrella which is not anticipated, rendered obvious, suggested, or even implied by any of the prior art boat canopies, either alone or in any combination thereof.

It is another object of the present invention to provide a new ski post-mounted boat umbrella which may be easily and efficiently manufactured and marketed.

It is a further object of the present invention to provide a new ski post-mounted boat umbrella which is of a durable and reliable construction.

An even further object of the present invention is to provide a new ski post-mounted boat umbrella which is susceptible of a low cost of manufacture with regard to both materials and labor, and which accordingly is then susceptible of low prices of sale to the consuming public, thereby making such ski post-mounted boat umbrella economically available to the buying public.

Still yet another object of the present invention is to provide a new ski post-mounted boat umbrella which provides in the apparatuses and methods of the prior art some of the advantages thereof, while simultaneously overcoming some of the disadvantages normally associated therewith.

Still another object of the present invention is to provide a new ski post-mounted boat umbrella for allowing the selective shading of a boat.

Even still another object of the present invention is to provide a new ski post-mounted boat umbrella that includes a boat with a cylindrical post having a bottom end fixedly coupled thereto and extended upwardly therefrom. Further, an umbrella assembly is coupled to the post.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
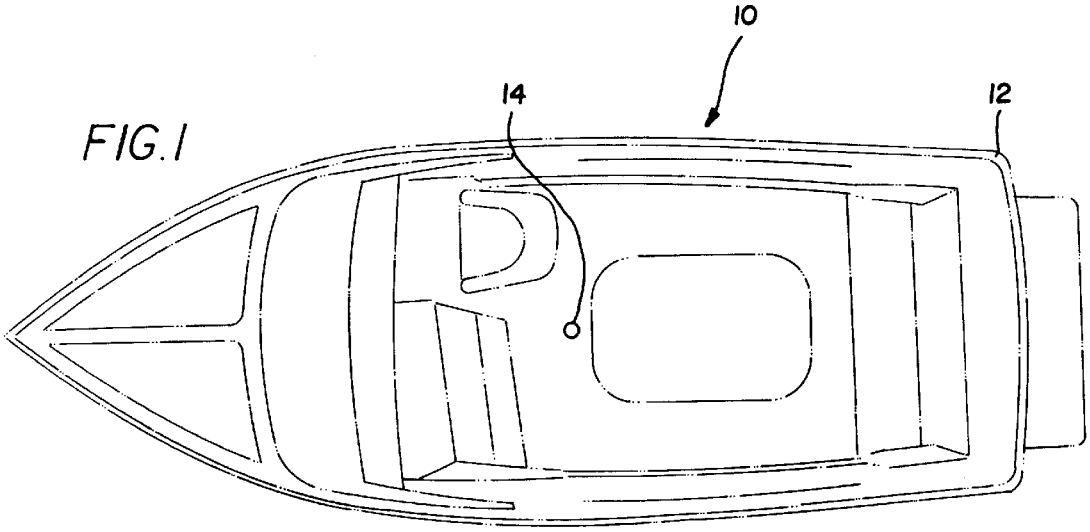
FIG. 1 is a top view of the ski boat associated with the present invention.
Figure 2:
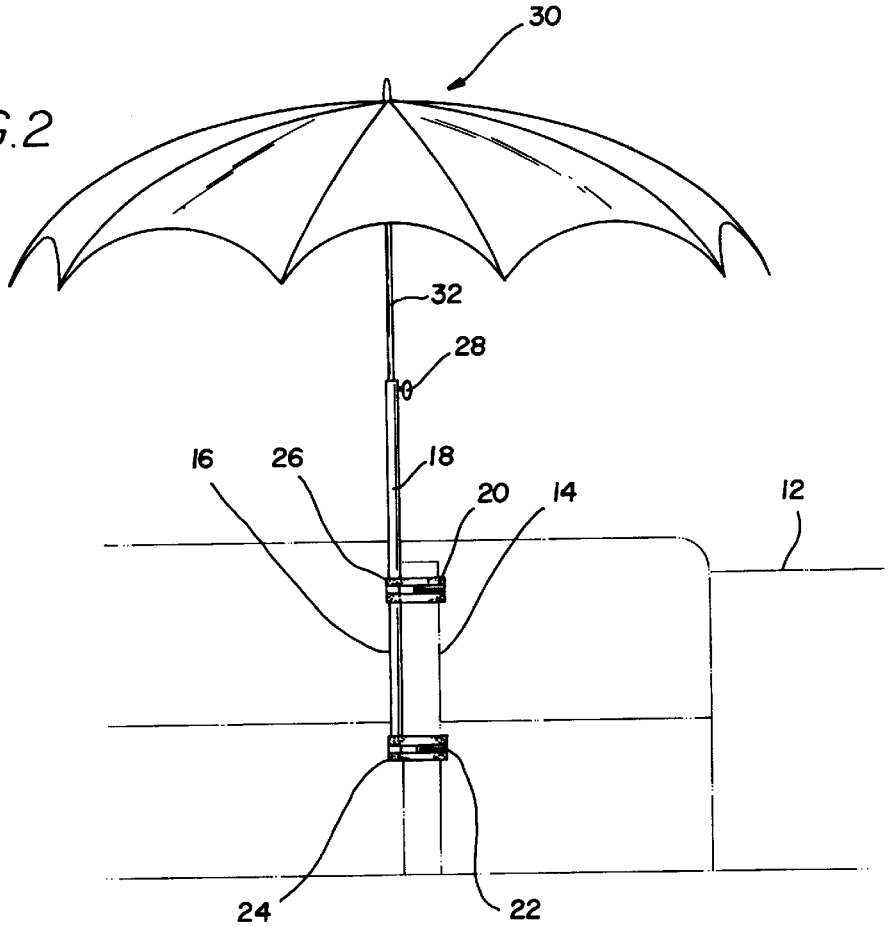
FIG. 2 is a side view of the present invention.

With reference now to the drawings, and in particular to FIGS. 1 through 2 thereof, a new ski post-mounted boat umbrella embodying the principles and concepts of the present invention and generally designated by the reference numeral 10 will be described.

The present invention, designated as numeral 10, includes a ski boat 12 with a smooth cylindrical post 14 having a bottom end fixedly coupled to a central extent of the boat. The post extends upwardly from the boat for releasably coupling with a line for pulling a skier.

Also included is a base 16 including a thin hollow rod 18 having a diameter less than that of the cylindrical post of the ski boat. The rod includes a pair of resilient hollow cylindrical sleeves 20 each having an open top and an open bottom. Each sleeve is equipped with a diameter equal to that of the cylindrical post of the ski boat. Further, a height of each sleeve is less than 1/10 that of the rod of the base. The sleeves are mounted to the rod of the base via clamps 22 in concentric relationship with respect to each other. Further, an axis about which the sleeves are situated resides in parallel with that of the rod. The foregoing clamps are preferably capable of being tightened via a screw or the like.

The sleeves include a first sleeve 24 mounted at a lower end of the rod of the base and a second sleeve 26 mounted at a central extent of the rod of the base. The rod of the base further has a threaded bore formed therein adjacent to an upper end thereof for receiving a set screw 28. In use, the sleeves are adapted to releasably receive the cylindrical post of the ski boat such that the rod of the base is vertically oriented. It should be noted that the sleeves may be situated along any selected height of the post.

Finally, an umbrella assembly 30 is provided including a solid cylindrical member 32 with height approximately equal to that of the hollow rod. A top end of the cylindrical member has a collapsible umbrella mounted thereon. The umbrella has a dome-shaped configuration and is collapsible via an underlying frame. The umbrella is preferably constructed from a nylon material. A bottom end of the umbrella is removably situated within the upper end of the rod of the base and further secured therein via the set screw.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A boat umbrella comprising, in combination:

a ski boat with a smooth cylindrical post having a bottom end fixedly coupled to a central extent of the boat and extending upwardly therefrom for releasably coupling with a line for pulling a skier;

a base including a thin hollow rod with a diameter less than that of the cylindrical post of the ski boat, the rod including a pair of resilient hollow cylindrical sleeves each having an open top and an open bottom each with a diameter equal to that of the cylindrical post of the ski boat, the sleeves mounted to the rod of the base via clamps in concentric relationship with respect to each other such that an axis about which the sleeves are situated resides in parallel with that of the rod, the sleeves including a first sleeve mounted at a lower end of the rod of the base and a second sleeve mounted at a central extent of the rod of the base, the rod of the base further having a threaded bore formed therein adjacent to an upper end thereof for receiving a set screw, wherein the sleeves are adapted to releasably receive the cylindrical post of the ski boat such that the rod of the base is vertically oriented; and an umbrella assembly including a solid cylindrical member with a top end having a collapsible umbrella mounted thereon and a bottom end removably situated within the upper end of the rod of the base and further secured therein via the set screw.

2. A boat umbrella comprising:

a boat with a post upwardly extending therefrom;

a base having a rod including a pair of resilient sleeves, the sleeves mounted to the rod of the base via clamps in concentric relationship with respect to each other such that an axis about which the sleeves are situated resides in parallel with that of the rod;

the sleeves including a first sleeve mounted at a lower end of the rod of the base and a second sleeve mounted at a central extent of the rod of the base;

the rod of the base further having a threaded bore formed therein adjacent to an upper end thereof for receiving a set screw, wherein the sleeves are adapted to releasably receive the post of the boat such that the rod of the base is vertically oriented; and an umbrella assembly including a member with a top end having a collapsible umbrella mounted thereon and a bottom end removably situated within the upper end of the rod of the base and further secured therein via the set screw.

3. The boat umbrella of claim 2, wherein the rod has a diameter less than that of the post of the boat.

4. The boat umbrella of claim 3, wherein the sleeves each have an open top and an open bottom each with a diameter equal to that of the post of the boat.

* * * * *